US008439212B2

(12) United States Patent
Clodfelter et al.

(10) Patent No.: US 8,439,212 B2
(45) Date of Patent: May 14, 2013

(54) TAMPER-EVIDENT CONTAINER CLOSURE WITH FLIP-TOP CAP

(75) Inventors: Chris Clodfelter, Evansville, IN (US); Carl Clement, Taverham (GB)

(73) Assignee: Berry Plastics Corporation, Evansville, IN (US)

( * ) Notice: Subject to any disclaimer, the term of this patent is extended or adjusted under 35 U.S.C. 154(b) by 281 days.

(21) Appl. No.: 12/875,901

(22) Filed: Sep. 3, 2010

(65) Prior Publication Data

US 2011/0100990 A1 May 5, 2011

Related U.S. Application Data

(60) Provisional application No. 61/257,363, filed on Nov. 2, 2009.

(51) Int. Cl.
*B65D 41/32* (2006.01)
*B65D 43/16* (2006.01)

(52) U.S. Cl.
USPC ..... 215/253; 215/235; 220/254.3; 220/266

(58) Field of Classification Search ..... 215/253, 215/235, 250; 220/254.3, 257.1, 266
See application file for complete search history.

(56) References Cited

U.S. PATENT DOCUMENTS

| | | | | | |
|---|---|---|---|---|---|
| 4,474,301 | A * | 10/1984 | Davis | 215/220 |
| 4,513,870 | A * | 4/1985 | Zaltsman | 215/46 |
| 4,709,823 | A * | 12/1987 | Beck et al. | 215/235 |
| 4,844,272 | A * | 7/1989 | Dutt | 215/232 |
| 5,088,613 | A * | 2/1992 | Dutt et al. | 215/250 |
| 5,435,456 | A * | 7/1995 | Dubach | 220/838 |
| 6,478,184 | B2 * | 11/2002 | Berge et al. | 220/831 |
| 7,303,088 | B2 | 12/2007 | Sawyer et al. | |
| 7,611,025 | B2 * | 11/2009 | Nusbaum et al. | 215/253 |
| 2008/0047976 | A1 | 2/2008 | Scheer et al. | |
| 2008/0264961 | A1 | 10/2008 | Sawyer | |
| 2011/0114593 | A1 * | 5/2011 | Ishii et al. | 215/253 |

* cited by examiner

*Primary Examiner* — Mickey Yu
*Assistant Examiner* — Niki Eloshway
(74) *Attorney, Agent, or Firm* — Barnes & Thornburg LLP

(57) ABSTRACT

A closure includes a body adapted to mount on a container having a discharge outlet and a cap configured to move relative to the body from a closed position covering the discharge outlet to an opened position uncovering the discharge outlet. The closure also includes frangible links coupled to the body and cap that break in response to first-time movement of the cap from the closed position to the opened position to alert an observer that the cap has been opened once before.

34 Claims, 5 Drawing Sheets

FIG. 1
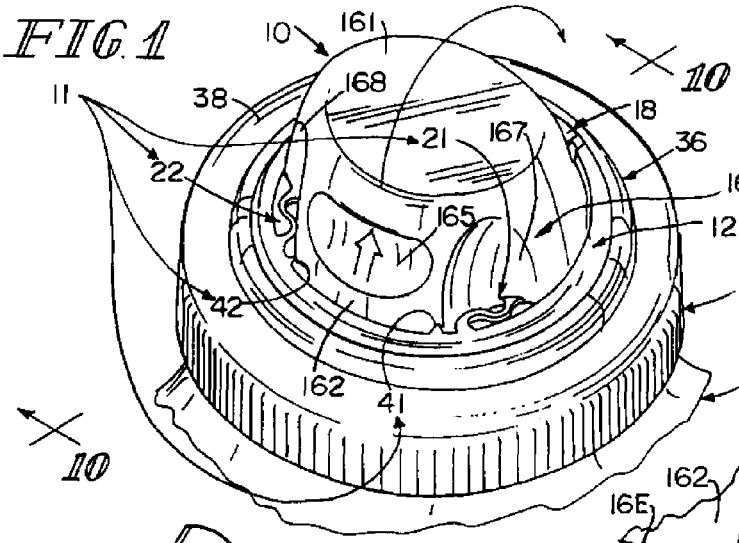
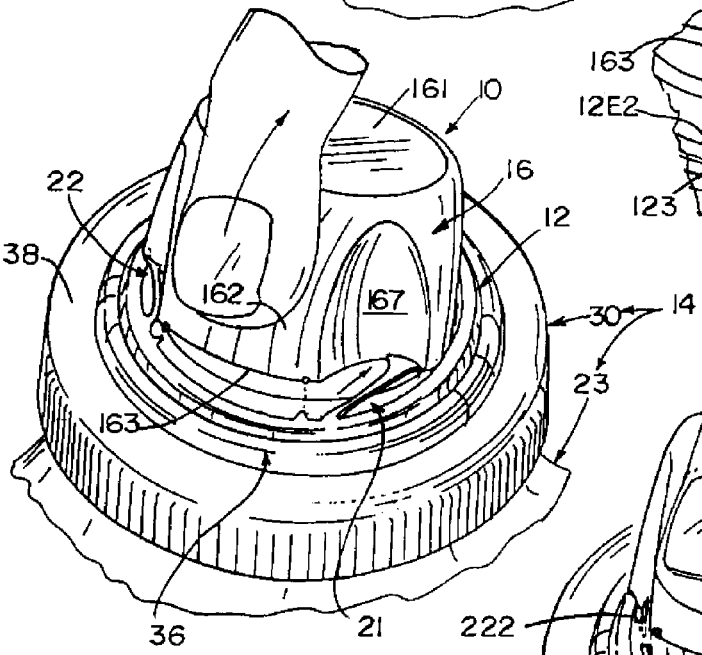
FIG. 2
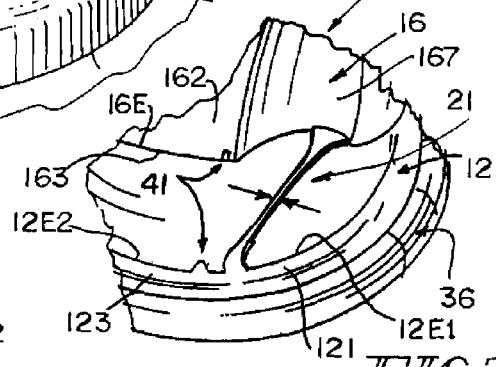
FIG. 3
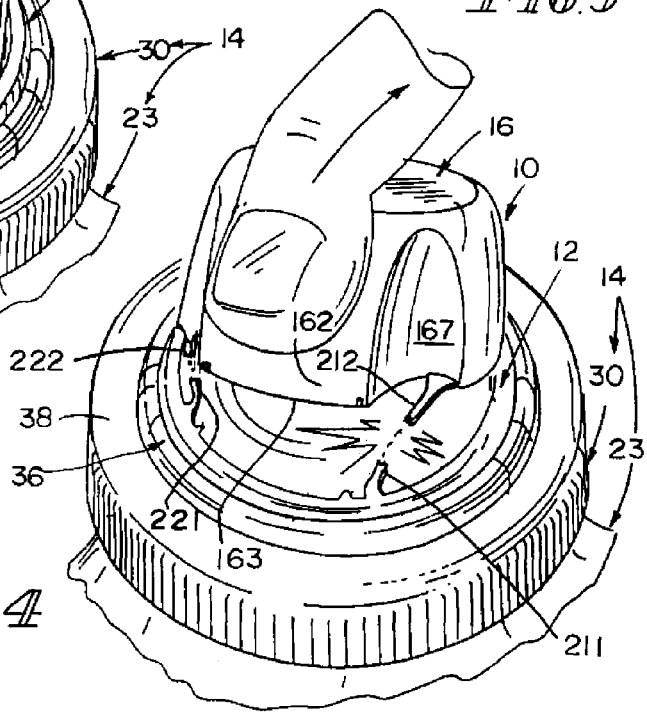
FIG. 4

TAMPER-EVIDENT CONTAINER CLOSURE WITH FLIP-TOP CAP

PRIORITY CLAIM

This application claims priority under 35 U.S.C. §119(e) to U.S. Provisional Application Ser. No. 61/257,363, filed Nov. 2, 2009, which is expressly incorporated by reference herein.

BACKGROUND

The present disclosure relates to closures for mounting on the top of bottles or other containers and, in particular, to a container closure including a flip-top cap. More particularly, the present disclosure relates to a container closure with a tamper-evident feature.

SUMMARY

In accordance with the present disclosure, a container closure is provided for coupling with a container. The container closure comprises a body adapted to be coupled to the container to permit selective release of a substance, such as a liquid from the container. In illustrative embodiments, the container closure also includes a hinge that is coupled to the body and a flip-top cap appended to the hinge for movement relative to the body between a closed position overlying a dispensing outlet included in the body and an opened position uncovering the dispensing outlet included in the body.

In illustrative embodiments, the container closure further includes at least one frangible strap interconnecting the ring-shaped body and the flip-top cap. In illustrative embodiments, the frangible strap is made out of an extensible material and is designed to break during first-time movement of the flip-top cap by a user from the closed position to the opened position. This strap is stretched during initial stages of movement of the flip-top cap relative to the ring-shaped body away from the closed position and toward an opened position. Once the strap is stretched beyond its elastic limit, it breaks and provides a tamper-evident signal, visible to any observer, that the flip-top cap has been moved at least once from the closed position to the opened position.

In illustrative embodiments, the frangible strap is S-shaped and configured to assume a somewhat straightened shape as it is stretched. Once overstretched and broken, one portion of the strap remains tethered to the ring-shaped body and another separate portion of the strap is tethered to the flip-top cap.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 1 is a perspective view of a closure mounted on a dispenser included in a container and coupled to an underlying bottle also included in the container and showing that the closure comprises a ring-shaped body coupled to the dispenser, a hinge coupled to a rear portion of the ring-shaped body, a flip-top cap coupled to the hinge for movement between a closed position shown in FIG. 1 and an opened position shown in FIG. 5 and a tamper-evident system including two spaced-apart S-shaped extensible and frangible straps as suggested in FIGS. 6 and 7;

FIG. 2 is a perspective view similar to FIG. 1 during an initial stage of pivoting movement of the flip top cap on the hinge and relative to the underlying ring-shaped body away from the closed position and showing a first stage of stretching of the frangible straps wherein each of the frangible straps has been stretched to change from the initial length shown in FIG. 1 to assume a first stretched length as shown in FIG. 2;

FIG. 3 is an enlarged partial perspective view of the closure of FIG. 2 during a later stage of pivoting movement of the flip-top cap on the hinge and relative to the underlying ring-shaped body further away from the closed position and showing a second stage of stretching of the frangible straps wherein each of the straps has been stretched further to assume a relatively longer second stretched length;

FIG. 4 is a perspective view similar to FIGS. 1 and 2 showing that each of the frangible straps has been stretched beyond its elastic limit and broken in response to still further pivoting movement of the flip-top cap on the hinge away from the closed position and toward the opened position shown in FIG. 5 so that, for example, one portion of each broken strap is tethered to the ring-shaped body and a separate portion of each broken strap is tethered to the flip top cap;

DETAILED DESCRIPTION OF THE DRAWINGS

Figure 5:
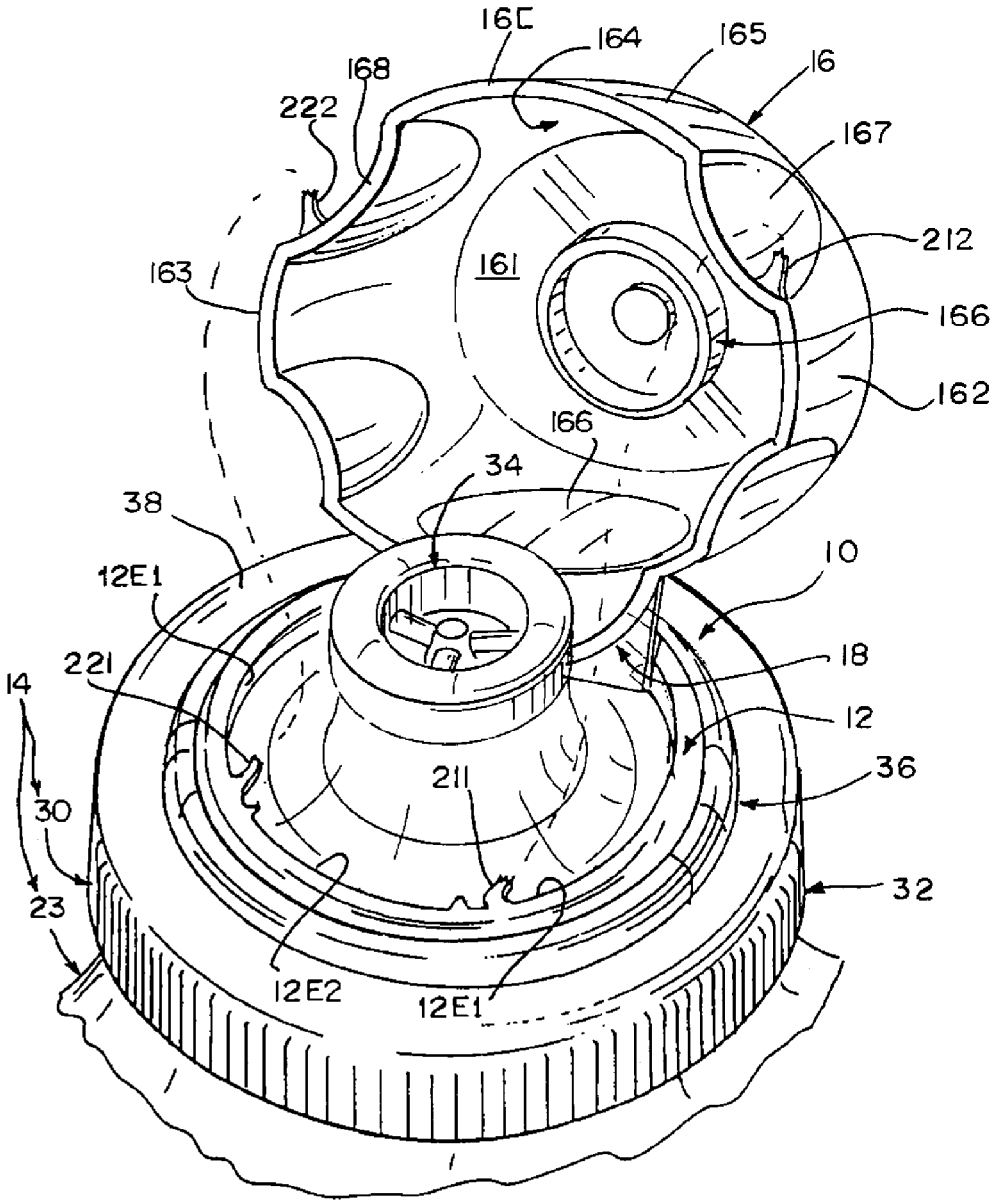
FIG. 5 is a perspective view of the closure similar to FIGS. 1, 2, and 4 showing the flip-top cap in the opened position exposing a tubular liquid-discharge outlet included in the dispenser mounted on the bottle and also showing that the two now-broken frangible straps provide a tamper-evident signal that would be visible to an observer suggesting that the flip-top cap has been opened at least once even after the previously opened flip-top cap has been pivoted on the hinge back toward the closed position shown in FIG. 1.
Figure 6:
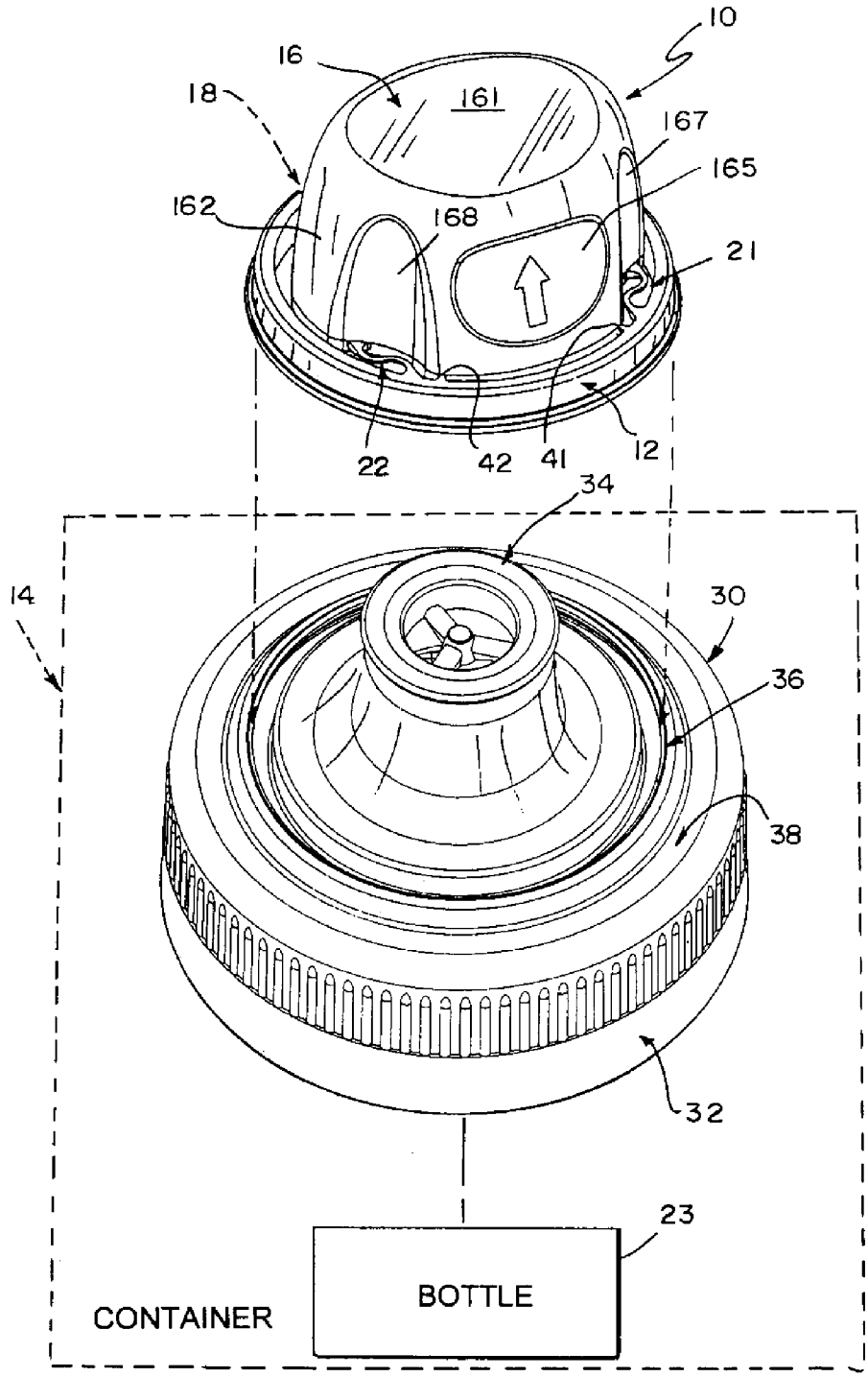
FIG. 6 is an exploded perspective assembly view showing a container comprising a bottle and a dispenser configured to mount on the bottle to close an opening into an interior region formed in the bottle and formed to include an upright tubular liquid-discharge outlet arranged to lie in fluid communication with the interior region of the bottle and showing the closure arranged to overlie and cover the upright tubular liquid-discharge outlet included in the dispenser when the closure is mounted on the dispenser and the flip-top cap is retained in the closed position.

As suggested in FIGS. 1 and 6, a container closure 10 includes a body 12 that is adapted to mate with a container 14, a flip-top cap 16, a hinge 18 interconnecting body 12 and flip-top cap 16, and first and second S-shaped frangible straps 21, 22 interconnecting body 12 and flip-top cap 16. When flip-top cap 16 is pivoted the first time on hinge 18 by an operator to move from a closed position shown in FIG. 1 to an opened position shown in FIG. 5, each of first and second frangible straps 21, 22 is stretched as suggested in FIGS. 2 and 3 and then breaks as suggested in FIG. 4. Broken frangible straps 21, 22 provide a visible tamper-evident signal to an observer indicating the flip-top cap 16 has been moved at least once from the closed position to the opened position.

Figure 10:
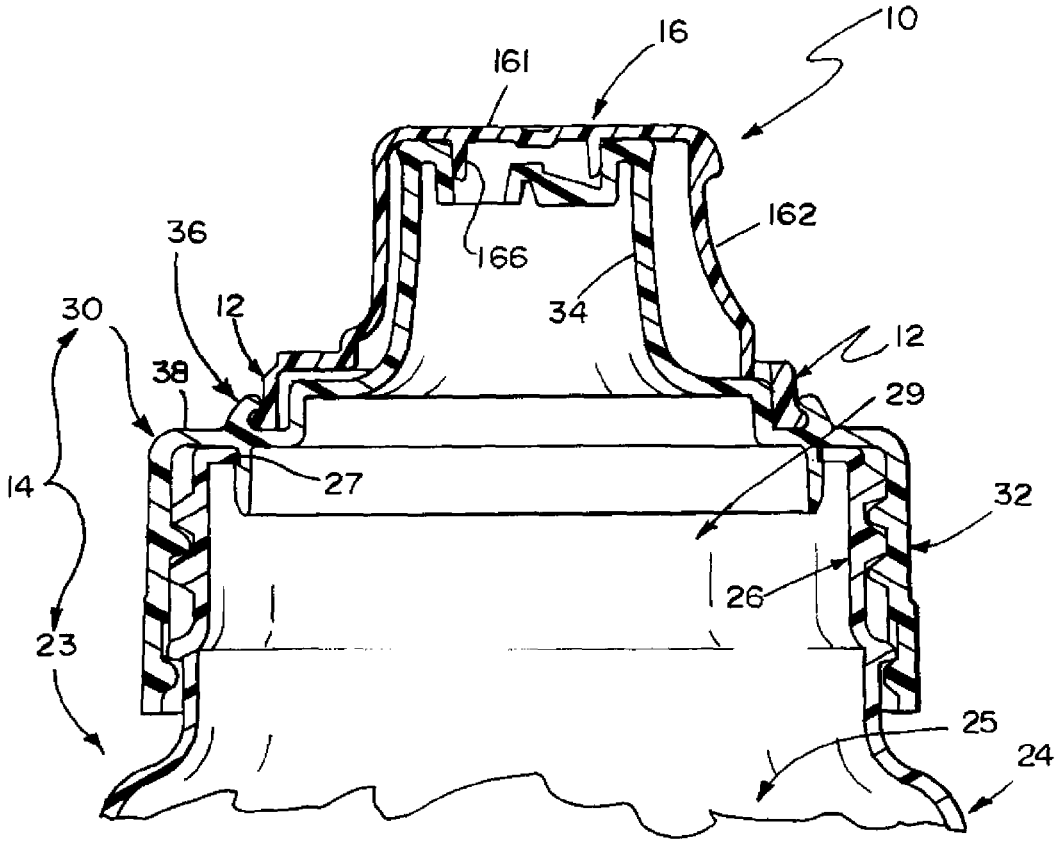
FIG. 10 is an enlarged sectional view of the closure and the container taken along line 10-10 of FIG. 1.

In an illustrative embodiment suggested in FIGS. 1, 6, and 10. Container 14 includes a bottle 23 including a vessel 24 formed to include an interior region 25 and a filler neck 26 coupled to vessel 24. Filler neck 26 is formed to include a mouth 27 opening into a passageway 29 formed in the filler neck 26 and arranged to communicate with interior region 25 of vessel 24. It is within the scope of this disclosure to provide a container of any suitable shape.

Container 14 also includes a dispenser 30 coupled to filler neck 26 of bottle 23 as suggested diagrammatically in FIG. 6 and illustratively in FIG. 10. In illustrative embodiments, dispenser 30 includes a neck mount 32 configured to mate with filler neck 26 of bottle 23, an outlet 34 communicating with filler neck passageway 29 and vessel interior region 25, and a closure retainer 36 arranged to lie in a top wall 38 of dispenser 30 as suggested in FIGS. 5, 6, and 10. In an illustrative embodiment, closure retainer 36 is configured to mate with (e.g., snap connection) body 12 of container closure 16 to anchor body 12 to dispenser 30 during movement of flip top cap 16 on hinge 18 relative to body 12 between closed and opened positions. It is within the scope of this disclosure to provide a dispenser of any suitable shape. In an illustrative embodiment, outlet 34 is tubular in shape and upright in orientation and configured to discharge liquids or other dispensable products stored in bottle 23.

Body 12 of container closure 10 is ring-shaped in an illustrative embodiment and configured to be mated to container 14 to couple closure 10 to container 14. In an illustrative embodiment, ring-shaped body 12 is coupled to closure retainer 36 of dispenser 30 as suggested in FIG. 10 to cause flip-top cap 16 to cover upright tubular liquid-discharge outlet 34 of dispenser 30 when flip-top cap 16 is moved on hinge 18 to assume the closed position.

Hinge 18 is coupled to body 12 and to flip-top cap 16 to support flip-top cap 16 for movement relative to body 12 from a closed position on body 12 covering liquid-discharge outlet 34 of dispenser 30 as suggested in FIG. 1 to an opened position uncovering liquid-discharge outlet 34 as shown, for example, in FIG. 5. It is within the scope of this disclosure to employ any suitable hinge.

Flip-top cap 16 is a dome-shaped member comprising a round top wall 161 and a somewhat cone-shaped side wall 162 in an illustrative embodiment as suggested in FIGS. 5 and 6. Side wall 162 extends downwardly from a perimeter edge of round top wall 161 and terminates at a lower edge 163 in an illustrative embodiment as suggested in FIGS. 4 and 5. Liquid-discharge outlet 34 extends into a hollow chamber 164 formed in flip-top cap 16 when flip-top cap 16 is moved to assume the closed position as suggested in FIGS. 5 and 10. A plug seal 166 configured to mate with and close liquid-discharge outlet 164 is coupled to an underside of round top wall 161 as shown, for example, in FIG. 5.

Container closure 10 further includes first and second frangible straps 21, 22 as shown, for example, in FIGS. 1-3, 6, 7, and 9. In an illustrative embodiment, each of straps 21, 22 is S-shaped and has one end coupled to ring-shaped body 12 and an opposite end coupled to flip-top cap 16 at a point near lower edge 163 as suggested in FIGS. 1, 6, 7, and 9. Frangible straps 21, 22 are arranged to lie in spaced-apart relation to one another as suggested in FIGS. 1, 6, and 7 to locate finger-grip region 165 on side wall 162 of flip-top cap 16 therebetween. Closure 10 is a monolithic component made of a plastics material in an illustrative embodiment.

During an initial stage of pivoting movement of flip-top cap 16 on hinge 16 on hinge 18 and relative to underlying ring-shaped body 12 away from the closed position, a first stage of stretching of frangible straps 21, 22 takes place as suggested in FIG. 2. Each of frangible straps 21, 22 has been stretched during this initial cap-motion stage to change from the initial length shown in FIG. 1 to assume a first stretched length as shown in FIG. 2.

During a later stage of pivoting movement of flip-top cap 16 on hinge 18 and relative to the underlying ring-shaped body 12 further away from the closed position, a second stage of stretching of frangible straps 21, 22 takes place as suggested in FIG. 3. Each of straps 21, 22 has been stretched further to assume a relatively longer second stretched length as shown, for example, in FIG. 3.

As suggested in FIG. 4, each of frangible straps 21, 22 has been stretched beyond its elastic limit and broken in response to still further pivoting movement of flip-top cap 16 on hinge 18 away from the closed position and toward the opened position shown in FIG. 5. This causes, for example, one portion 211, 221 of each broken strap 21, 22 to be tethered to ring-shaped body 12 and a separate portion 212, 222 of each broken strap 21, 22 to be tethered to flip-top cap 16.

Flip-top cap 16 is shown in the opened position in FIG. 5 exposing tubular liquid-discharge outlet 34 included in dispenser 30 mounted on bottle 23. The two now-broken frangible straps 21, 22 provide a tamper-evident signal that would be visible to an observer suggesting that flip-top cap 16 has been pivoted on hinge 18 back toward the closed position shown in FIG. 1.

The tamper-evident stretch-to-break straps 21, 22 have been profiled in such a way for when flip-top cap 16 is first opened from the original molded state, the S-profiled stretch straps 21, 22 each begin to straighten in line with the arc of motion of living hinge 18. Straightening occurs for a small portion of hinge arc travel and, as the material approaches a yield point of the material, the stress is controlled to a thinner portion of the frangible strap 21, 22. Due to the relationship between the material and the geometrical value(s) of the thinner portion of the strap, each strap 21, 22 will stretch prior to breakage, providing visible changes to the strap both in length, width, and shape.

Each stretch strap 21, 22 has been profiled in such a way whereby the strap will only break within the thinner portion of the strap (the break-zone) as suggested in FIGS. 3 and 4. The break point is not controlled to a specific point within the break-zone. This is intentional in an illustrative embodiment to provide non-uniform break points to increase the visual tamper evidence. Geometrical transition of material forming each frangible strap 21, 22 extending between body 12 and flip top cap 16 cooperate, in part, to achieve a tamper-evident signal feature in accordance with the present disclosure.

Figure 7:
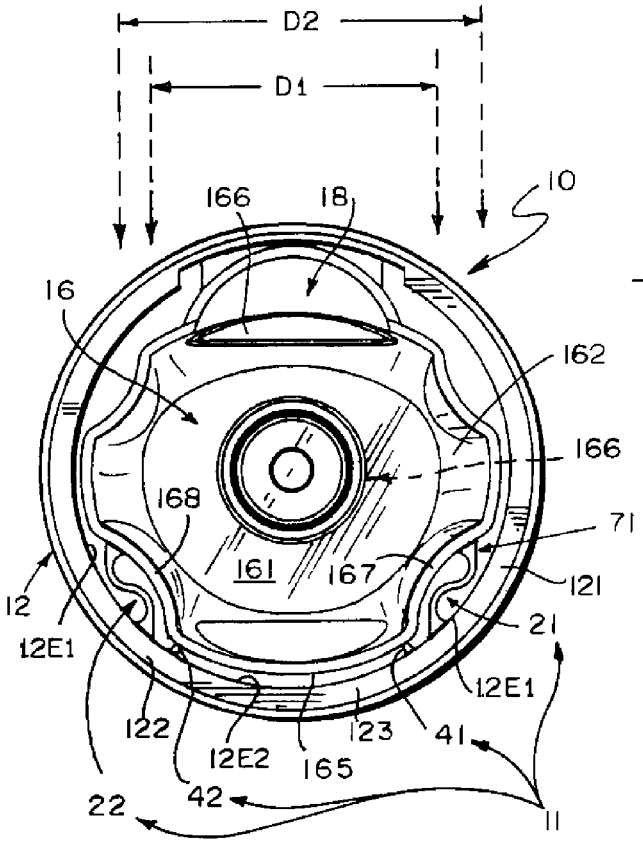
FIG. 7 is a top plan view of the closure of FIGS. 1 and 6 when the flip-top cap as manufactured is tethered by the unbroken frangible straps to remain in the closed position on the underlying ring-shaped base before the flip-top cap is moved by an operator the first time to assume the opened position as suggested in FIGS. 2-5.

In illustrative embodiments, container closure 10 also includes two radially extending frangible connectors 41, 42 arranged to lie in a space provided between frangible straps 21, 22 and configured to interconnect ring-shaped body 12 to flip-top cap 16 as shown, for example, in FIGS. 1, 6, and 7. These frangible connectors 41, 42 are configured to break as suggested in FIG. 2 in response to movement of flip-top cap 16 on hinge 18 away from the closed position and before breakage of frangible straps 21, 22 as suggested in FIG. 4.

In illustrative embodiments, a tamper-evident closure 10 includes a body 12 adapted to mount onto a container 14 formed to include an outlet 34 opening into an interior region 25, 29 formed in container 14 as suggested in FIGS. 6 and 10. Closure 10 further includes a cap 16 configured to be mounted on body 12 in a closed position overlying outlet 34 as suggested in FIGS. 1 and 6 and separated from body 12 in an opened position uncovering outlet 34 as suggested in FIG. 5.

Closure 10 also includes tamper-evident means 11 (see FIGS. 1 and 7) for breaking in response to movement of cap 16 relative to body 12 from the closed position toward the opened position as suggested in FIGS. 1-4 to provide a tamper-evident signal visible to an observer (see FIG. 4) that cap 16 has been moved relative to body 12 from the closed position toward the opened position. Tamper-evident means 11 is coupled to cap 16 and to body 12 as suggested in FIGS. 1 and 7.

Figure 9:
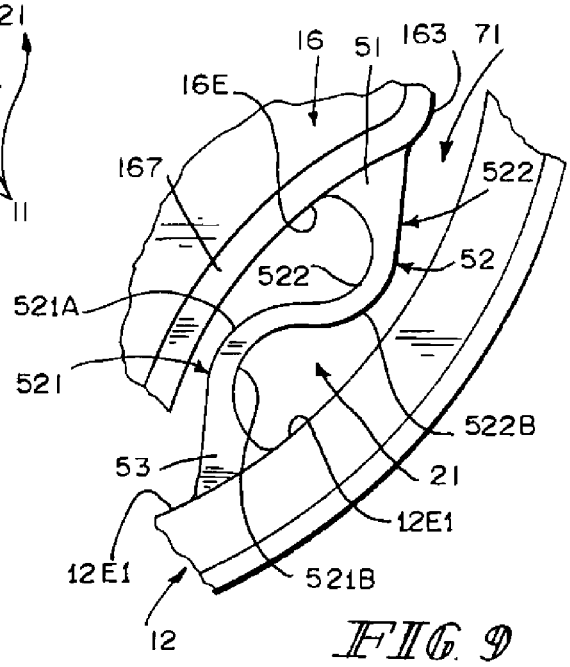
FIG. 9 is an enlarged view of one of the unbroken S-shaped frangible straps shown in FIG. 7.
Figure 8:
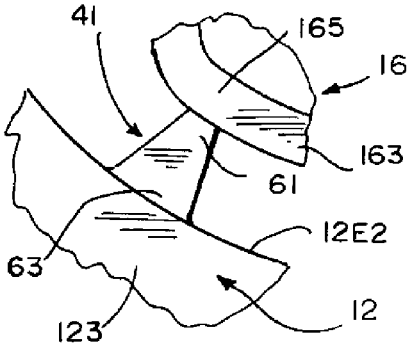
FIG. 8 is an enlarged view of one of the unbroken frangible connectors shown in FIG. 7.

In illustrative embodiments, tamper-evident means 11 includes at least one radially extending frangible connector (e.g., 41, 42) arranged to interconnect body 12 and cap 16 and at least one frangible strap (e.g., 21, 22) as suggested in FIGS. 7-9. Each frangible strap 21, 22 has an undulating shape (e.g., S-shape) and has an inner portion 51 coupled to cap 16, an outer portion 53 coupled to body 12, and a serpentine portion 52 arranged to interconnect companion inner and outer portions 51, 52 as shown, for example, in FIG. 9.

Each of the S-shaped frangible straps 21, 22 is made of an elastic material. The elastic material is configured to stretch and straighten as suggested in FIGS. 1-3 during movement of cap 16 from the closed position toward the opened position to provide visible changes in length, width, and shape of said S-shaped frangible strap 21 or 22 during movement of cap 16 from the closed position toward the opened position. Such stretching and straightening continues until the elastic material approaches a yield point of the elastic material and breaks in the serpentine portion 52 as suggested in FIG. 4 to provide the tamper-evident signal.

In illustrative embodiments, cap 16 is a movable flip-top cap as suggested in FIGS. 1-5. Also, in illustrative embodiments, closure 10 comprises hinge means 18 coupled to body 12 and to flip-top cap 16 for supporting flip-top cap 16 for movement relative to body 12 from the closed position to the opened position to break, in series, first all of the radially extending frangible connectors 41, 42 as suggested in FIG. 2 and then each of the S-shaped frangible straps 21, 22 during first time movement of flip-top cap 16 relative to body 12 from the closed position to the opened position as suggested in FIG. 4 to provide the tamper-evident signal.

Flip-top cap 16 includes a slide wall 162 having a rearwardly facing rear portion 166 coupled to hinge means 18 and an opposite forwardly facing front portion 165 arranged to lie in close proximity to body 12 in the closed position of cap 16 as suggested in FIG. 7. Each of radially extending frangible connectors 41, 42 is coupled at a radially outer end 63 thereof to body 12 and at a radially inner end 63 thereof to front portion 165 of flip-top cap 16 as suggested in FIGS. 7 and 8.

Side wall 162 of flip-top cap 16 further includes a concave portion 167 arranged to lie between front and rear portions 165, 166 on one side of cap 16 and in spaced-apart relation to body 12 in the closed position of cap 16 to form a strap-receiving space 71 therebetween as suggested in FIGS. 7 and 9. First S-shaped frangible strap 21 is arranged to lie unbroken in strap-receiving space 71 coupled at an outer end 53 thereof to body 12 and at an inner end 51 thereof to concave portion 167 of side wall 162 of flip-top cap 16 as suggested in FIGS. 1, 6, and 9 until first-time movement of flip-top cap 16 from the closed position to the opened position as suggested in FIG. 4 to provide the tamper-evident signal.

Side wall 162 of flip-top cap 16 further includes another concave portion 168 arranged to lie between front and rear portions 165, 166 on another side of cap 16 and in spaced-apart relation to body 12 in the closed position of cap 16 to form a strap-receiving space 72 therebetween. Second S-shaped frangible strap 22 is arranged to lie unbroken in strap-receiving space 72 coupled at an outer end 53 thereof to body 12 and at an inner end 51 thereof to concave portion 168 of side wall 162 of flip-top cap 16 as suggested in FIGS. 1 and 7 until first-time movement of flip-top cap 16 from the closed position to the opened position as suggested in FIG. 4 to provide the tamper-evident signal.

Body 12 is annular and includes a right-side arcuate portion 121 coupled to first S-shaped frangible strap 21, a left-side arcuate portion 122 coupled to second S-shaped frangible strap 22, and a center arcuate portion 120. Center arcuate portion 120 is arranged to lie between and to interconnect right-side and left-side arcuate portions 121, 122 and to lie in confronting relation to front portion 165 of side wall 162 of flip-top cap 16 as suggested in FIG. 7. The radially outer end 63 of each of radially extending frangible connectors 41, 42 is coupled to center arcuate portion 123 of body 12 as suggested in FIGS. 7 and 8.

Serpentine portion 52 of each S-shaped frangible strap 21, 22 is arranged to lie between and in spaced-apart relation to body 12 and cap 16 in the closed position of cap 16 as suggested in FIGS. 7 and 9. Outer portion 53 of first S-shaped frangible strap 21 is arranged to lie at a first distance D1 from outer portion 53 of second S-shaped frangible strap 22 as suggested in FIG. 7. Inner portion 51 of first S-shaped frangible strap 21 is arranged to lie at a relatively greater second distance D2 from inner portion 51 of the second S-shaped frangible strap 22 as suggested in FIG. 7.

Each of the serpentine portions 52 includes first and curved segments 521, 522 as shown, for example, in FIG. 9. First curved segment 521 mates with a companion outer portion 53 and has a convex surface 521A facing toward cap 16. Second curved segment 522 interconnects first curved segment 521 and a companion inner portion 51 and has a concave surface 522A facing toward cap 16 as suggested in FIG. 9. Each first curved segment 521 also has a concave surface 521B facing away from cap 16 and toward body 12. Each second curved segment 522 also has a convex surface 522B facing away from cap 16 and toward body 12 as also suggested in FIG. 9.

Body 12 includes an interior edge 12E1 coupled to outer portions 53 of each of first and second S-shaped frangible straps 21, 22 and formed to include a curved edge section 12E2 extending between said outer portions 53 as suggested in FIGS. 7-9. The first and second radially extending frangible connectors 41, 42 are coupled to cap 16 and to edge section 12E2 and arranged to lie between said outer portions 53 of first and second S-shaped frangible straps 21, 22 as shown, for example, in FIG. 7.

Cap 16 includes a concave edge 16E facing toward an opposing concave edge 12E1 of body 12. Inner portion 51 of first S-shaped frangible strap 21 is coupled to concave edge 12E1 of cap 16 as suggested in FIG. 9. Outer portion 53 of first S-shaped frangible strap 21 is coupled to concave edge 12E1 of body 12. Serpentine portion 52 of first S-shaped frangible strap 21 is arranged to lie between and in spaced-apart relation to each of concave edges of cap 16 and body 12 when cap 16 is in the closed position and before any breakage of first S-shaped frangible strap 21. Concave edge 16E of cap 16 is defined by a first curved surface having a first radius of curvature as suggested in FIG. 9. Concave edge 12E1 of body 12 is defined by a second curved surface having a relatively greater second radius of curvature as also suggested in FIG. 9.

The invention claimed is:

1. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes at least one radially extending not S-shaped frangible connector arranged to interconnect the body and the cap and extend inwardly in a radial direction toward a vertical central axis of body from the body to the cap and at least one S-shaped frangible strap, each S-shaped frangible strap having an inner portion coupled to the cap, an outer portion coupled to the body, and a serpentine portion arranged to interconnect companion inner and outer portions.

2. The closure of claim 1, wherein each of the S-shaped frangible straps is made of an elastic material configured to stretch and straighten during movement of the cap from the closed position toward the opened position to provide visible changes in length, width, and shape of said S-shaped frangible strap during movement of the cap from the closed position toward the opened position until the elastic material approaches a yield point of the elastic material and breaks in the serpentine portion to provide the tamper-evident signal.

3. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes at least one radially extending not S-shaped frangible connector arranged to interconnect the body and the cap and at least one S-shaped frangible strap, each S-shaped frangible strap having an inner portion coupled to the cap, an outer portion coupled to the body, and a serpentine portion arranged to interconnect companion inner and outer portions and wherein the cap is a flip-top cap and further comprising hinge means coupled to the body and to the flip-top cap for supporting the flip-top cap for movement relative to the body from the closed position to the opened position to break, in series, first all of the radially extending frangible connectors and then each of the S-shaped frangible straps during first time movement of the flip-top cap relative to the body from the closed position to the opened position to provide the tamper-evident signal.

4. The closure of claim 3, wherein the flip-top cap includes a side wall having a rearwardly facing rear portion coupled to the hinge means and an opposite forwardly facing front portion arranged to lie in close proximity to the body in the closed position of the cap and each of the radially extending frangible connectors is coupled at a radially outer end thereof to the body and at a radially inner end thereof to the front portion of the flip-top cap.

5. The closure of claim 4, wherein the side wall of the flip-top cap further includes a concave portion arranged to lie between the front and rear portions and in spaced-apart relation to the body in the closed position of the cap to form a strap-receiving space therebetween and a first of the S-shaped frangible straps is arranged to lie unbroken in the strap-receiving space coupled at an outer end thereof to the body and at an inner end thereof to the concave portion of the side wall of the flip-top cap until first-time movement of the flip-top cap from the closed position to the opened position to provide the tamper-evident signal.

6. The closure of claim 4, wherein the body is annular and includes a right-side arcuate portion coupled to a first of the S-shaped frangible straps, a left-side arcuate portion coupled to a second of the S-shaped frangible straps, and a center arcuate portion arranged to lie between and to interconnect the right-side and left-side arcuate portions and to lie in confronting relation to the front portion of the side wall of the flip-top cap and the radially outer end of each of the radially extending frangible connectors is coupled to the center arcuate portion of the body.

7. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes at least one radially extending not S-shaped frangible connector arranged to interconnect the body and the cap and at least one S-shaped frangible strap, each S-shaped frangible strap having an inner portion coupled to the cap, an outer portion coupled to the body, and a serpentine portion arranged to interconnect companion inner and outer portions and wherein the serpentine portion of each S-shaped frangible strap is arranged to lie in a horizontal plane that is orthogonal to a vertical central axis extending through the body and the cap when the cap is located in the closed position and to lie between and in spaced-apart relation to the body and the cap in the closed position of the cap.

8. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes at least one radially extending not S-shaped frangible connector arranged to interconnect the body and the cap and at least one S-shaped frangible strap, each S-shaped frangible strap having an inner portion coupled to the cap, an outer portion coupled to the body, and a serpentine portion arranged to interconnect companion inner and outer portions and wherein the outer portion of a first of the S-shaped frangible straps is arranged to lie at a first distance from the outer portion of a second of the S-shaped frangible straps and the inner portion of the first of the S-shaped frangible straps is arranged to lie at a relatively greater second distance from the inner portion of the second of the S-shaped frangible straps.

9. The closure of claim 8, wherein each of the serpentine portions includes a first curved segment mating with a companion outer portion and having a convex surface facing toward the cap and a second curved segment interconnecting the first curved segment and a companion inner portion and having a concave surface facing toward the cap.

10. The closure of claim 9, wherein each first curved segment also has a concave surface facing away from the cap and toward the body and each second curved segment also has a convex surface facing away from the cap and toward the body.

11. The closure of claim 8, wherein the body includes an interior edge coupled to the outer portions of each of the first and second S-shaped frangible straps and formed to include an edge section extending between said outer portions and a first of the radially extending frangible connectors is coupled to the cap and to the edge section and arranged to lie between said outer portions of the first and second S-shaped frangible straps.

12. The closure of claim 11, wherein the interior edge is annular.

13. The closure of claim 11, wherein the edge section is curved.

14. The closure of claim 11, wherein the cap includes a concave edge facing toward an opposing concave edge of the body, the inner portion of the first of the S-shaped frangible straps is coupled to the concave edge of the cap, and the outer portion of the first of the S-shaped frangible straps is coupled to the concave edge of the body.

15. The closure of claim 14, wherein the serpentine portion of the first of the S-shaped frangible straps is arranged to lie between and in spaced-apart relation to each of the concave edges of the cap and the body when the cap is in the closed position and before any breakage of the first of the S-shaped frangible straps.

16. The closure of claim 14, wherein the concave edge of the cap is defined by a first curved surface having a first radius of curvature and the concave edge of the body is defined by a second curved surface having a relatively greater second radius of curvature.

17. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes a first undulating frangible strap lying in a horizontal plane that is orthogonal to a vertical central axis of the body having an inner portion coupled to the cap, an outer portion coupled to the body, and a serpentine portion arranged to interconnect the inner and outer portions.

18. The closure of claim 17, wherein the first undulating frangible strap is made of an elastic material configured to stretch and straighten during movement of the cap from the closed position toward the opened position to cause the serpentine portion to stretch and thin as compared to the companion inner and outer portions to provide visible changes in length, width, and shape of the first undulating frangible strap during movement of the cap from the closed position toward the opened position until the elastic material approaches a yield point of the elastic material and breaks in the serpentine portion to provide the tamper-evident signal.

19. The closure of claim 18, wherein the serpentine portion includes a first curved segment mating with the outer portion and having a convex surface facing toward the cap and a second curved segment interconnecting the first curved segment and the inner portion and having a concave surface facing toward the cap.

20. The closure of claim 19, wherein each first curved segment also has a concave surface facing away from the cap and toward the body and each second curved segment also has a convex surface facing away from the cap and toward the body.

21. The closure of claim 17, wherein the cap includes a concave edge facing toward an opposing concave edge of the body, the inner portion of the first undulating frangible strap is coupled to the concave edge of the cap, and the outer portion of the first undulating frangible strap is coupled to the concave edge of the body.

22. The closure of claim 21, wherein the serpentine portion of the first undulating frangible strap is arranged to lie between and in spaced-apart relation to each of the concave edges of the cap and the body when the cap is in the closed position and before any breakage of the first undulating frangible strap.

23. The closure of claim 21, wherein the concave edge of the cap is defined by a first curved surface having a first radius of curvature and the concave edge of the body is defined by a second curved surface having a relatively greater second radius of curvature.

24. The closure of claim 17, wherein the cap is a flip-top cap and further comprising hinge means coupled to the body and to the flip-top cap for supporting the flip-top cap for movement relative to the body from the closed position to the opened position to break the serpentine portion of the undulating frangible strap during first time movement of the flip-top cap relative to the body from the closed position to the opened position to provide the tamper-evident signal.

25. The closure of claim 17, wherein the serpentine portion of the first undulating frangible strap is arranged to lie between and in spaced-apart relation to the body and the cap in the closed position of the cap.

26. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes a first undulating frangible strap having an inner portion coupled to the cap, an outer portion coupled to the body, and a serpentine portion arranged to interconnect the inner and outer portions, wherein the cap is a flip-top cap and further comprising hinge means coupled to the body and to the flip-top cap for supporting the flip-top cap for movement relative to the body from the closed position to the opened position to break the serpentine portion of the undulating frangible strap during first time movement of the flip-top cap relative to the body from the closed position to the opened position to provide the tamper-evident signal, and wherein the flip-top cap includes a side wall having a rearwardly facing rear portion coupled to the hinge means and an opposite forwardly facing front portion arranged to lie in close proximity to the body in the closed position of the cap, the side wall of the flip-top cap further includes a first concave portion arranged to lie between the front and rear portions and in spaced-apart relation to the body in the closed position of the cap to form a first strap-receiving space therebetween, and the first undulating frangible strap is arranged to lie unbroken in the first strap-receiving space coupled at an outer end thereof to the body and at an inner end thereof to the first concave portion of the side wall of the flip-top cap until first-time movement of the flip-top cap from the closed position to the opened position to provide the tamper-evident signal.

27. The closure of claim 26, wherein the tamper-evident means further includes a second undulating frangible strap and the side wall of the flip-top cap further includes a second concave portion arranged to lie between the front and rear portions and in spaced-apart relation to the body in the closed position of the cap to form a second strap-receiving space therebetween, and the second undulating frangible strap is arranged to lie unbroken in the second strap-receiving space coupled at an outer end thereof to the body and at an inner end thereof to the second concave portion of the side wall of the flip-top cap until first-time movement of the flip-top cap from the closed position to the opened position to provide the tamper-evident signal.

28. The closure of claim 27, wherein the body is annular and includes a right-side arcuate portion coupled to the first undulating frangible strap, a left-side arcuate portion coupled to the second undulating frangible strap, and a center arcuate portion arranged to lie between and to interconnect the right-side and left-side arcuate portions and to lie in confronting relation to the front portion of the side wall of the flip-top cap and between the first and second strap-receiving spaces in the closed position of the flip-top cap.

29. The closure of claim 27, wherein the outer portion of the first undulating frangible strap is arranged to lie at a first distance from a outer portion of the second undulating frangible strap and the inner portion of the first undulating frangible strap is arranged to lie at a relatively greater second distance from an inner portion of the second undulating frangible strap.

30. A tamper-evident closure comprising a body adapted to mount onto a container formed to include an outlet opening into an interior region formed in the container, a cap configured to be mounted on the body in a closed position overlying the outlet and separated from the body in an opened position uncovering the outlet, and tamper-evident means coupled to the cap and to the body for breaking in response to movement of the cap relative to the body from the closed position toward the opened position to provide a tamper-evident signal visible to an observer that the cap has been moved relative to the body from the closed position toward the opened position, wherein the tamper-evident means includes a first undulating frangible strap having an inner portion coupled to the cap, an outer portion coupled to the body, and a serpentine portion arranged to interconnect the inner and outer portions, wherein the serpentine portion includes a first curved segment mating with the outer portion and having a convex surface facing toward the cap and a second curved segment interconnecting the first curved segment and the inner portion and having a concave surface facing toward the cap and wherein the cap includes a concave edge facing toward an opposing concave edge of the body, the inner portion of the first frangible strap is coupled to the concave edge of the cap, and the outer portion of the first frangible strap is coupled to the concave edge of the body.

31. The closure of claim 30, wherein the first curved segment also has a concave surface facing away from the cap and toward the body and the second curved segment also has a convex surface facing away from the cap and toward the body.

32. The closure of claim 30, wherein the body includes an annular interior edge coupled to the outer portion.

33. The closure of claim 30, wherein the serpentine portion of the first undulating frangible strap is arranged to lie between and in spaced-apart relation to each of the concave edges of the cap and the body when the cap is in the closed position and before any breakage of the first undulating frangible strap.

34. The closure of claim 30, wherein the concave edge of the cap is defined by a first curved surface having a first radius of curvature and the concave edge of the body is defined by a second curved surface having a relatively greater second radius of curvature.

* * * * *